US008497768B2

(12) United States Patent
Brown

(10) Patent No.: US 8,497,768 B2
(45) Date of Patent: Jul. 30, 2013

(54) ANTI-THEFT, EMERGENCY SYSTEM

(76) Inventor: Thomas J. Brown, Staten Island, NY (US)

( * ) Notice: Subject to any disclaimer, the term of this patent is extended or adjusted under 35 U.S.C. 154(b) by 891 days.

(21) Appl. No.: 12/499,481

(22) Filed: Jul. 8, 2009

(65) Prior Publication Data

US 2011/0006921 A1 Jan. 13, 2011

(51) Int. Cl.
*B60R 25/10* (2006.01)

(52) U.S. Cl.
USPC ..... 340/426.11; 340/984; 340/425.5; 340/426.12

(58) Field of Classification Search
USPC ..... 340/984
See application file for complete search history.

(56) References Cited

U.S. PATENT DOCUMENTS

| | | | | |
|---|---|---|---|---|
| 4,354,174 | A * | 10/1982 | Heidman, Jr. | 340/426.3 |
| 4,596,303 | A * | 6/1986 | Tremblay | 180/287 |
| 5,355,140 | A * | 10/1994 | Slavin et al. | 342/386 |
| 6,992,458 | B2 * | 1/2006 | Hashimoto et al. | 318/568.13 |
| 2010/0253488 | A1 * | 10/2010 | Rork et al. | 340/425.5 |

OTHER PUBLICATIONS

PCT International Search Report and Written Opinion for PCT/US2010/041175 mailed on Sep. 1, 2010.

* cited by examiner

*Primary Examiner* — Travis Hunnings
(74) *Attorney, Agent, or Firm* — Kenyon & Kenyon LLP

(57) ABSTRACT

Disclosed is an antitheft, emergency system for a vehicle. The system may include a system activation switch, at least one emergency switch, an engine shutoff element connected to the engine, and an emergency transmitter. The at least one emergency switch may trigger the engine shutoff element to render the engine inoperational and may simultaneously, covertly trigger an emergency transmitter to transmit a distress signal.

26 Claims, 5 Drawing Sheets

20

ANTI-THEFT, EMERGENCY SYSTEM

FIELD OF THE INVENTION

The present invention relates to an anti-theft, emergency system for a vehicle, in particular an anti-theft, emergency system for a marine vehicle.

BACKGROUND

Marine vehicles may encounter a variety of emergency situations, such as, for example, theft or piracy. Presently, several methods and systems may be used to prevent theft or piracy of marine vehicles.

The most common systems used to deter piracy include the use of fire hoses. These fire hoses may be used to spray sea water at pirate vehicles or at pirates attempting to board the marine vehicles. These fire hoses, or fire monitors, may be either manually operated or remotely controlled.

In addition, some deterrent systems may use non-lethal ammunition rounds, such as, for example, rubber balls, rubber bullets, stun grenades, and tasers, aimed at pirate vehicles or pirates attempting to board the marine vehicles.

Further, other deterrent systems may use non-lethal laser light systems to illuminate or "dazzle" pirates with non-blinding laser devices. Also, further deterrent systems may use electromagnetic or sonic energy to deter and/or warn pirates and pirate vehicles, possibly from a long range.

Although all of the conventional methods and systems strive to prevent theft or piracy, they do not adequately provide any backup measures if they are unsuccessful in preventing theft or boarding of the vehicle by pirates.

In this regard, engines for marine vehicles, in particular engines for tugboats, may include a large fuel reservoir to hold fuel during normal operation. When such an engine is shut off such that a fuel supply from the fuel tank is closed, the large fuel reservoir of the engine may still contain a substantial amount of fuel. This large fuel reservoir may normally assist in quickly starting up the engine for future operation.

However, in emergency situations such as, for example, theft or piracy, it may be advantageous to shut off the engine instantaneously such that no more fuel is available to the engine. In situations in which the conventional methods of deterring theft or piracy have been unsuccessful, the large fuel reservoir may allow the vehicle to be operated for a substantial time and distance even after fuel supply from the fuel tank has been closed.

SUMMARY

Therefore, an anti-theft, emergency shutdown system for vehicles has been developed. It may be advantageous to prevent the continued operation of the vehicle by the use of an anti-theft, emergency shutdown system according to the present invention that may prevent the use of fuel available in the large fuel reservoir. Further, in the case of theft or piracy of marine vehicles, it may be advantageous to prevent the easy disarmament of the anti-theft, emergency shutdown system according to the present invention. Moreover, it may be advantageous in the case of theft or piracy of marine vehicles to simultaneously and covertly transmit a distress signal to other marine vehicles or authorities for immediate assistance.

In a non-limiting embodiment of the present invention, an anti-theft, emergency shutdown system for a vehicle may include a system activation switch, at least one emergency shutoff switch, and an engine shutoff element, in which the system activation switch is configured to activate the at least one emergency shutoff switch, the at least one emergency shutoff switch is configured to trigger the engine shutoff element, and the engine shutoff element is configured to instantaneously shutdown the vehicle engine.

In an alternative non-limiting embodiment of the invention, the system may further include at least one of (i) an audio and (ii) a visual indication of activation of the system activation switch.

In an alternative non-limiting embodiment of the invention, the at least one emergency shutoff switch may be situated at various locations within the vehicle.

In an alternative non-limiting embodiment of the invention, the at least one emergency shutoff switch may be hidden in plain sight.

In an alternative non-limiting embodiment of the invention, the at least one emergency shutoff switch may be one of (i) a wired and (ii) a wireless connection.

In an alternative non-limiting embodiment of the invention, the engine shutoff element may be a fuel shutoff valve.

In an alternative non-limiting embodiment of the invention, the fuel shutoff valve may be a solenoid.

In an alternative non-limiting embodiment of the invention, the engine shutoff element may be an emergency stop circuit.

In an alternative non-limiting embodiment of the invention, the emergency stop circuit may be one of (i) a relay and (ii) a four-pole relay.

In an alternative non-limiting embodiment of the invention, the system may further include an emergency transmitter.

In an alternative non-limiting embodiment of the invention, the at least one emergency shutoff switch may be configured to trigger the emergency transmitter.

In an alternative non-limiting embodiment of the invention, the at least one emergency shutoff switch may be configured to simultaneously trigger the engine shutoff element and the emergency transmitter.

In an alternative non-limiting embodiment of the invention, the at least one emergency shutoff switch may be configured to covertly trigger the emergency transmitter.

In an alternative non-limiting embodiment of the invention, the emergency transmitter may be an emergency position indicating radiobeacon (EPIRB).

In another non-limiting embodiment of the present invention, a method of operating an anti-theft, emergency shutdown system for a vehicle, may include activating, via a system activation switch, at least one emergency shutoff switch, and triggering, via the at least one emergency shutoff switch, an engine shutoff element, thereby initiating instantaneous shutdown of the vehicle engine.

In an alternative non-limiting embodiment of the invention, the method may further include providing at least one of (i) an audio and (ii) a visual indication of activation of the system activation switch.

In an alternative non-limiting embodiment of the invention, the triggering of the engine shutoff element via the at least one emergency shutoff switch may occur by one of (i) a wired and (ii) a wireless connection.

In an alternative non-limiting embodiment of the invention, the engine shutoff element may shut off fuel supply to the engine via a fuel shutoff valve.

In an alternative non-limiting embodiment of the invention, the engine shutoff element may shut off fuel supply to the engine via an emergency stop circuit.

In an alternative non-limiting embodiment of the invention, the method may further include triggering, via the at least one emergency shutoff switch, an emergency transmitter.

In an alternative non-limiting embodiment of the invention, the at least one emergency shutoff switch may simultaneously trigger the engine shutoff element and the emergency transmitter.

In an alternative non-limiting embodiment of the invention, the at least one emergency shutoff switch may covertly trigger the emergency transmitter.

In yet another non-limiting embodiment of the present invention, a method of deterring hostile takeover of a vehicle may include activating, via a system activation switch, at least one emergency shutoff switch, and triggering, via the at least one emergency shutoff switch, an engine shutoff element, thereby initiating instantaneous shutdown of the vehicle engine.

In an alternative non-limiting embodiment of the invention, the method may further include triggering, via the at least one emergency shutoff switch, an emergency transmitter.

In an alternative non-limiting embodiment of the invention, the at least one emergency shutoff switch may simultaneously trigger the engine shutoff element and the emergency transmitter.

In an alternative non-limiting embodiment of the invention, the at least one emergency shutoff switch may covertly trigger the emergency transmitter.

In still another non-limiting embodiment of the present invention, an anti-theft, emergency system for a vehicle may include a system activation switch, at least one emergency switch, and an emergency transmitter, in which the system activation switch is configured to activate the at least one emergency switch, and the at least one emergency switch is configured to trigger the emergency transmitter.

Other features and aspects of the present invention will become more fully apparent from the following brief description of the drawings, the detailed description of the non-limiting embodiments, the appended claims and the accompanying drawings.

DETAILED DESCRIPTION OF THE EMBODIMENTS

Figure 1:
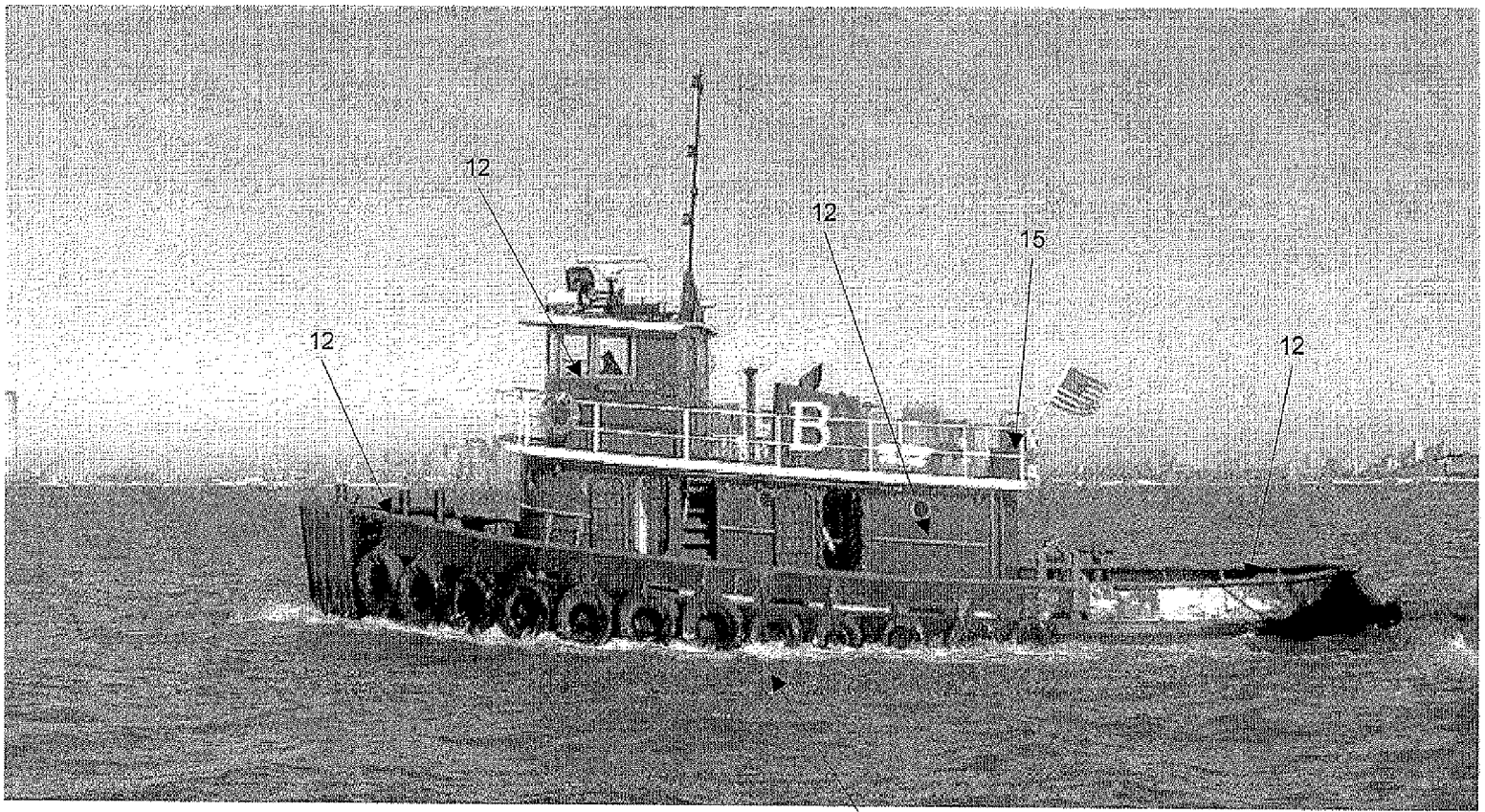
FIG. 1 illustrates an exemplary marine vehicle including an exemplary embodiment of the anti-theft, emergency shutdown system according to the present invention.

FIG. 1 illustrates an exemplary marine vehicle 1 including an exemplary embodiment of the anti-theft, emergency shutdown system 10 according to the present invention. The anti-theft, emergency shutdown system 10 may include a system activation switch 11, at least one emergency shutoff switch 12, an engine shutoff element 13 connected to the engine 14, and an emergency transmitter 15.

The exemplary marine vehicle 1 of FIG. 1 shows the system activation switch 11, engine shutoff element 13, and engine 14 situated relatively close to each other in a lower level of the vehicle, e.g. the engine room. Further, the exemplary marine vehicle 1 of FIG. 1 includes multiple emergency shutoff switches 12 situated at various locations throughout the vehicle, e.g. near the bow, in the wheelhouse, in the main cabin, near the stern, etc. Moreover, the exemplary marine vehicle 1 of FIG. 1 shows an emergency transmitter 15 situated on an exterior of the vehicle, e.g. on an upper deck. All locations shown in FIG. 1 are merely exemplary and may be altered or modified as desired.

Figure 2:
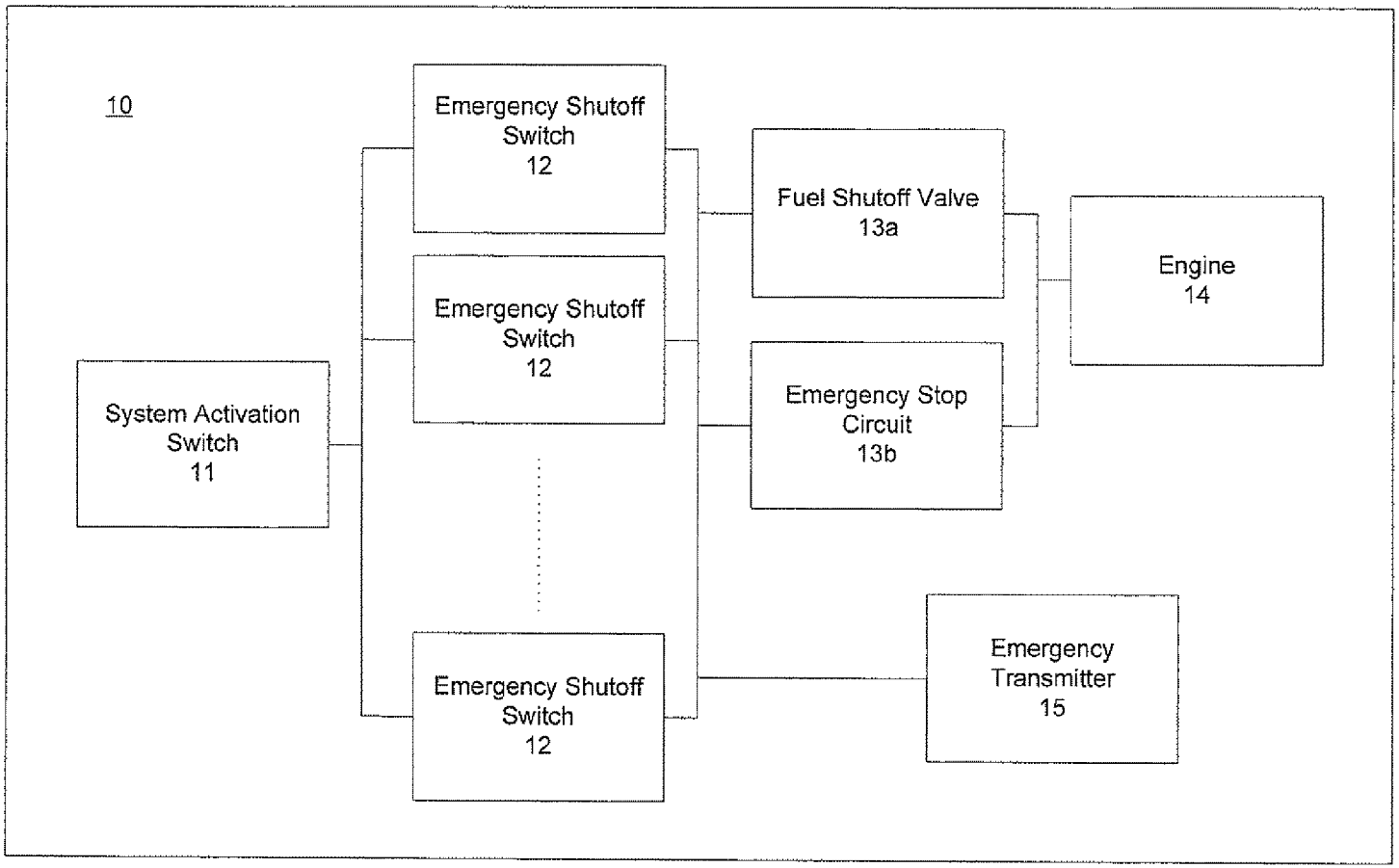
FIG. 2 illustrates a schematic diagram of an exemplary embodiment of the anti-theft, emergency shutdown system according to the present invention.

FIG. 2 illustrates a schematic diagram of an exemplary embodiment of the anti-theft, emergency shutdown system 10 according to the present invention. As described, the anti-theft, emergency shutdown system 10 may include a system activation switch 11, at least one emergency shutoff switch 12, an engine shutoff element 13 connected to the engine 14, and an emergency transmitter 15.

The system activation switch 11 may be situated at any location in the vehicle. The vehicle may also include an audio and/or visual indication of activation of the system activation switch 11. An audio indication may include a constant tone, or any other signal audible to passengers of the vehicle. A visual indication may include a light indicator, e.g. an LED (light-emitting diode), or any other signal visible to passengers of the vehicle.

When switched on, the system activation switch 11 activates at least one emergency shutoff switch 12. The at least one emergency shutoff switch 12 may be situated at any location in the vehicle. The at least one emergency shutoff switch 12 may be situated at multiple locations that are easily accessible by passengers of the vehicle. Moreover, the at least one emergency shutoff switch 12 may be connected to the engine shutoff element 13 by a wired or a wireless connection. In the case of a wireless connection, the at least one emergency shutoff switch 12 may also include at least one portable, wireless transmitter, e.g. a keyfob, that may be carried by a passenger of the vehicle, or also by a marine authority.

When the at least one emergency shutoff switch 12 is switched on, an engine shutoff element 13 is triggered. The engine shutoff element 13 may be a fuel shutoff valve 13*a*, such as, for example, a solenoid for use with mechanically controlled engines. Alternatively or additionally, the engine shutoff element 13 may be an emergency stop circuit 13*b*, such as, for example, a relay or a four-pole relay for use with electronically controlled engines. When the engine shutoff element 13 is triggered, the fuel shutoff valve and/or emergency stop circuit 13*a*, 13*b* may immediately and/or instantaneously prevent the further provision of fuel to the engine 14. Even if the engine 14 includes a large fuel reservoir, the engine shutoff element 13 may be positioned and/or connected such that the engine 14 may not be supplied with fuel from the large fuel reservoir.

The engine 14 may comprise more than a single engine, e.g., a port engine and a starboard engine, or more than two engines. In the case of a plurality of engines 14, each engine 14 may include one or more engine shutoff elements 13, or multiple engines 14 may be jointly connected to one or more engine shutoff elements 13.

The anti-theft, emergency shutdown system 10 may be configured such that once the at least one emergency shutoff switch 12 is switched on, thereby triggering the engine shutoff element 13 and shutting down the engine 14, the system 10 may be reset only by resetting the system activation switch 11 and/or the engine shutoff element 13. Until such time as the system 10 is reset by the system activation switch 11 and/or the engine shutoff element 13, the engine 14 may not be supplied with fuel, thereby rendering the vehicle inoperational.

For example, the engine shutoff element 13 may be configured as an emergency stop circuit 13*b* including a four-pole relay. Accordingly, when the emergency stop circuit 13*b* is triggered by the at least one emergency shutoff switch 12, at least one pole of the four-pole relay may hold its position until the system activation switch 11 is reset. The system activation switch 11 and the emergency stop circuit 13*b* may thereby prevent simple override of the system 10.

Further, the system activation switch 11, the at least one emergency shutoff switch 12, and/or the engine shutoff element 13 may be hidden, concealed or disguised. By hiding, concealing or disguising the components of the system 10, the system 10 may be particularly useful in preventing theft and/or piracy of vehicles. Moreover, the components of the system 10 may be "hidden in plain sight." That is, the system activation switch 11, the at least one emergency shutoff switch 12, and/or the engine shutoff element 13 may be plainly visible to passengers of the vehicle but disguised, for example, as other types of switches or other components of the vehicle. In this manner, a plurality of the at least one emergency shutoff switch 12 may be situated at various locations of the vehicle without drawing attention.

In addition, the at least one emergency shutoff switch 12 may also trigger an emergency transmitter 15. The emergency transmitter 15 may alert other nearby vehicles, or a monitored distress system by transmitting information related to the distressed vehicle. For example, the emergency transmitter 15 may be an emergency position indicating radiobeacon (EPIRB) that transmits to the Global Maritime Distress & Safety System (GMDSS) operated by the U.S. Coast Guard. Further, the at least one emergency shutoff switch 12 may trigger the engine shutoff element 13 and the emergency transmitter 15 simultaneously. Moreover, the at least one emergency shutoff switch 12 may trigger the emergency transmitter 15 covertly such that hostile parties are not aware of the distress signal being transmitted.

Figure 3:
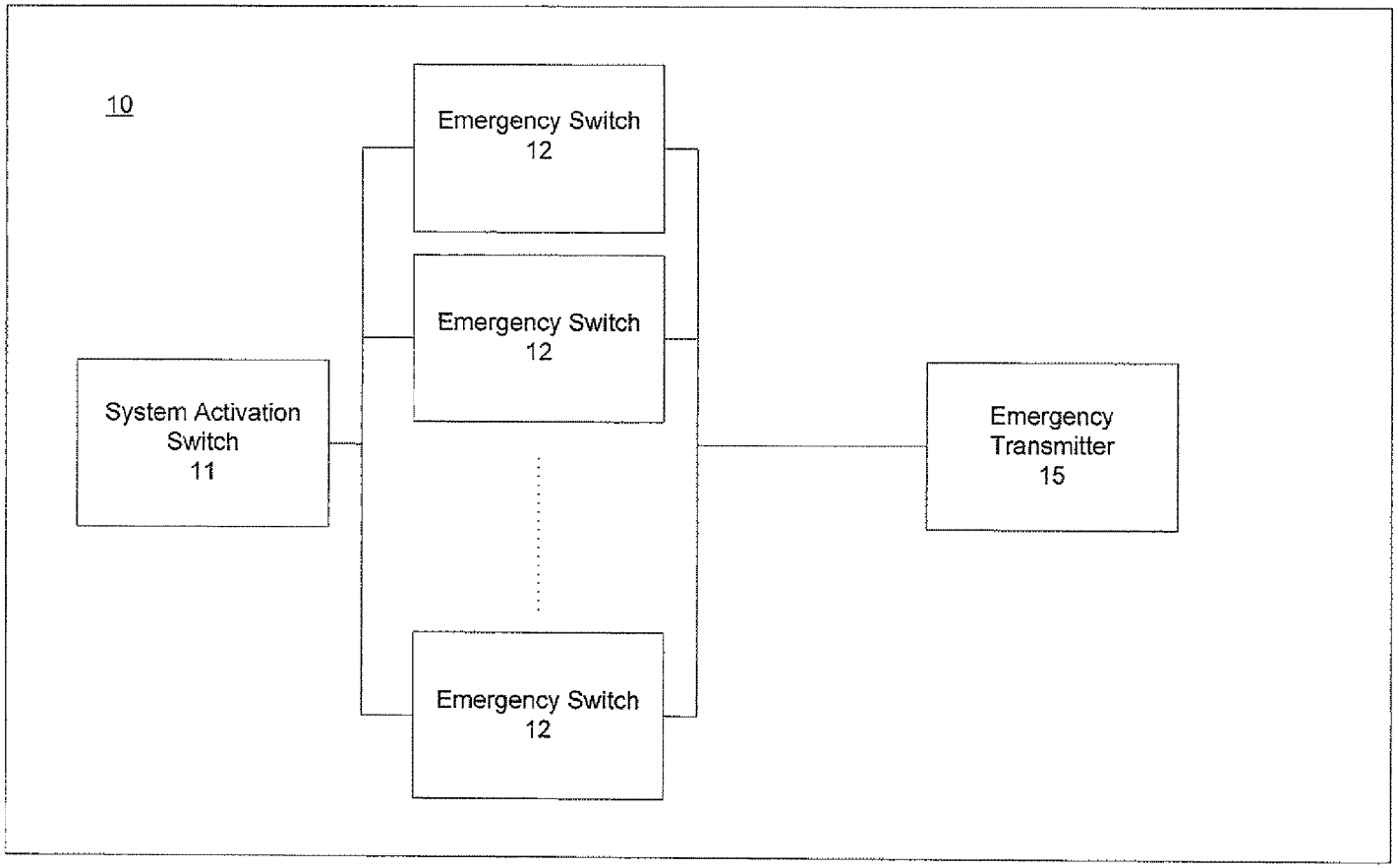
FIG. 3 illustrates a schematic diagram of another exemplary embodiment of the anti-theft, emergency system according to the present invention.

FIG. 3 illustrates a schematic diagram of another exemplary embodiment of the anti-theft, emergency system 10 according to the present invention. The system 10 described above with respect to FIG. 2 may alternatively be used on any vehicles having an emergency transmitter 15 on board. For example, non-propulsion vehicles or vessels, e.g., oil barges if boarded in an anchorage or terminal, may also include the anti-theft, emergency system 10.

As shown in FIG. 3, the anti-theft, emergency system 10 may include a system activation switch 11, at least one emergency switch 12, and an emergency transmitter 15. With the exception of the absence of an engine shutoff element 13 and engine 14, the remaining aspects of the system 10 as shown in FIG. 3 are similar to the system 10 as described above with respect to FIGS. 1 and 2.

Figure 4:
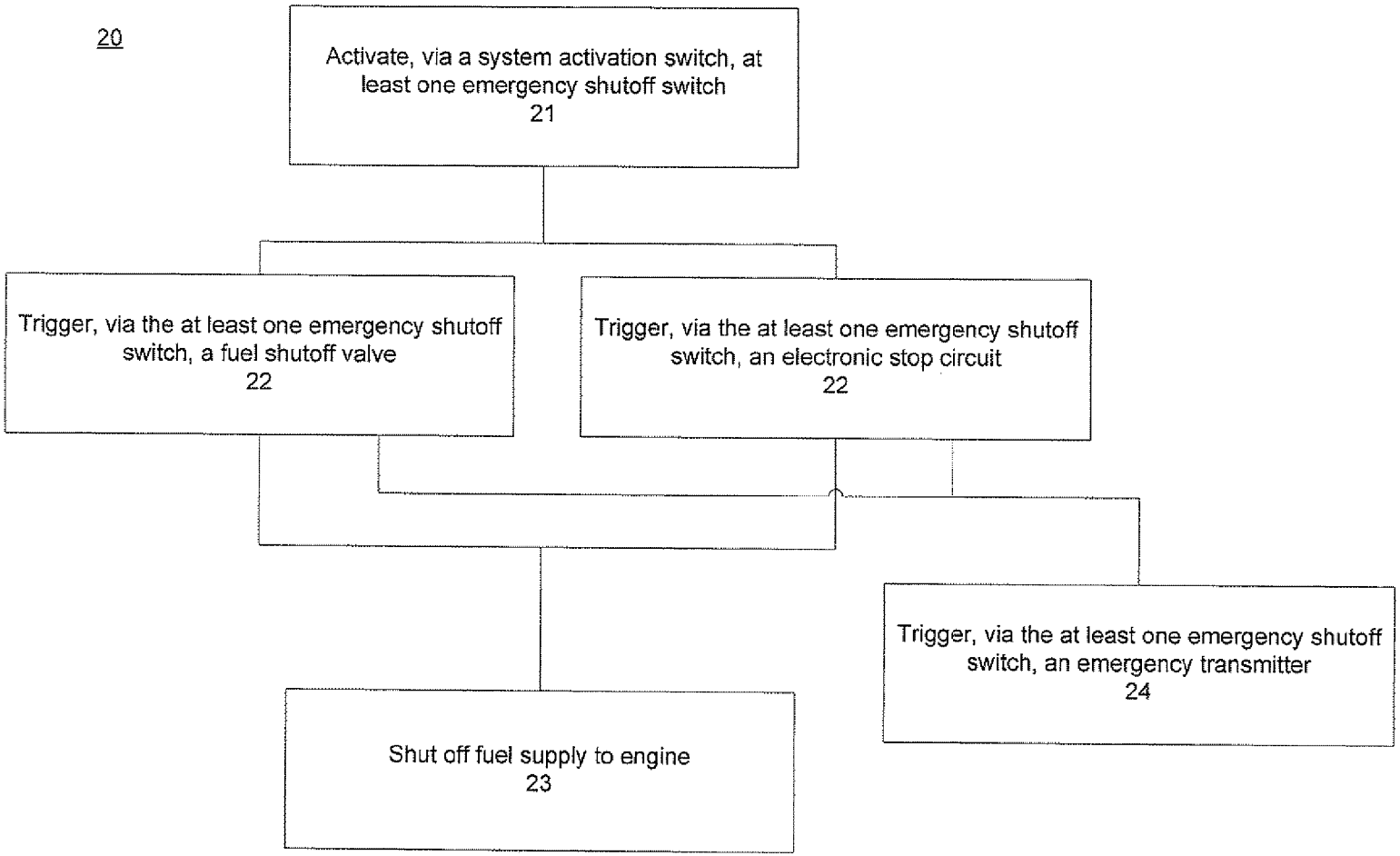
FIG. 4 illustrates a schematic flow diagram of an exemplary method of operating the anti-theft, emergency shutdown system according to the present invention.

FIG. 4 illustrates a schematic flow diagram of an exemplary method 20 of operating the anti-theft, emergency shutdown system 10 according to the present invention. The exemplary method 20 shown in FIG. 4 may also show a method of deterring hostile takeover of a vehicle.

At step 21, a system activation switch 11 is turned on in order to activate at least one emergency shutoff switch 12. The system activation switch 11 may be situated at any location in the vehicle. When the system 10 is thus activated, the system may also include an audio and/or visual indication of activation of the system activation switch 11.

The at least one emergency shutoff switch 12 may also be situated at any location in the vehicle. The at least one emergency shutoff switch 12 may be situated at multiple locations that are easily accessible by passengers of the vehicle. Moreover, the at least one emergency shutoff switch 12 may be connected to the engine shutoff element 13 by a wired or a wireless connection. In the case of a wireless connection, the at least one emergency shutoff switch 12 may also include at least one portable, wireless transmitter, e.g. a keyfob, that may be carried by a passenger of the vehicle, or also by a marine authority.

At step 22, the at least one emergency shutoff switch 12 is turned on in order to trigger an engine shutoff element 13. The engine shutoff element 13 may be a fuel shutoff valve 13*a* and/or an emergency stop circuit 13*b*. When the engine shutoff element 13 is triggered, the fuel shutoff valve and/or emergency stop circuit 13*a*, 13*b* may immediately and/or instantaneously prevent the further provision of fuel to the engine 14, at step 23. Even if the engine 14 includes a large fuel reservoir, the engine shutoff element 13 may be positioned and/or connected such that the engine 14 may not be supplied with fuel from the large fuel reservoir.

The anti-theft, emergency shutdown system 10 may be configured such that once the at least one emergency shutoff switch 12 is switched on at step 22, thereby triggering the engine shutoff element 13 and shutting down the engine 14 at step 23, the system 10 may be reset only by resetting the system activation switch 11 and/or the engine shutoff element 13. Until such time as the system 10 is reset by the system activation switch 11 and/or the engine shutoff element 13, the engine 14 may not be supplied with fuel, thereby rendering the vehicle inoperational.

In addition, at step 24, the at least one emergency shutoff switch 12 may also trigger an emergency transmitter 15. The emergency transmitter 15 may alert other nearby vehicles, or a monitored distress system by transmitting information related to the distressed vehicle. Further, turning on the at least one emergency shutoff switch 12 may trigger the engine shutoff element 13 at step 22 and the emergency transmitter 15 at step 24 simultaneously. Moreover, the emergency transmitter 15 may be triggered covertly such that hostile parties are not aware of the distress signal being transmitted.

The foregoing description discloses only non-limiting embodiments of the present invention. Modification of the above-disclosed anti-theft, emergency shutdown system for a vehicle, as well as methods for using the same, which fall within the scope of the invention, will be readily apparent to those of ordinary skill in the art.

Figure 5:
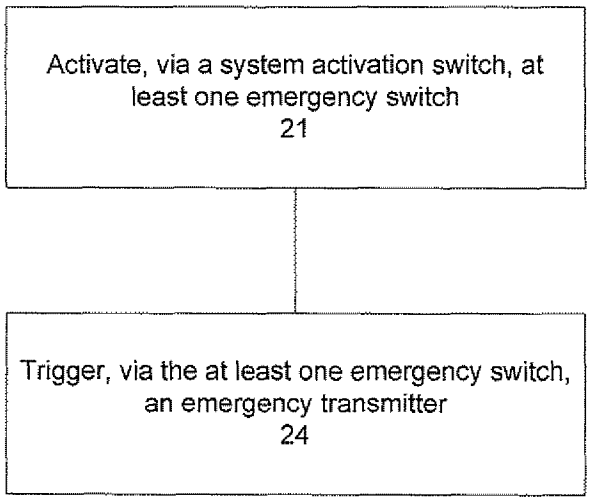
FIG. 5 illustrates a schematic flow diagram of another exemplary method of operating the anti-theft, emergency system according to the present invention.

FIG. 5 illustrates a schematic flow diagram of another exemplary method 20 of operating the anti-theft, emergency system 10 according to the present invention. The exemplary method 20 shown in FIG. 5 may also show a method of deterring hostile takeover of a vehicle.

The method 20 described above with respect to FIG. 4 may alternatively be used on any vehicles having an emergency transmitter 15 on board. For example, non-propulsion vehicles or vessels, e.g., oil barges if boarded in an anchorage or terminal, may also include the anti-theft, emergency system 10.

As shown in FIG. 5, the method 20 of operating the anti-theft, emergency system 10 may include steps 21 and 24 as described above with respect to the method of FIG. 4. With the exception of the absence of steps 22 and 23 related to an engine shutoff element 13 and engine 14, the remaining aspects of the method 20 as shown in FIG. 5 are similar to the method 20 as described above with respect to FIG. 4.

Accordingly, while the present invention has been disclosed in connection with the above non-limiting embodiments, it should be understood that other embodiments may fall within the spirit and scope of the invention, as defined by the following claims.

What is claimed is:

1. An anti-theft, emergency shutdown system for a vehicle, comprising:

a system activation switch;

at least one emergency shutoff switch; and an engine shutoff element;

wherein the system activation switch is configured to activate the at least one emergency shutoff switch, the at least one emergency shutoff switch is configured to trigger the engine shutoff element, and the engine shutoff element is configured to instantaneously shutdown the vehicle engine;

wherein the at least one emergency shutoff switch is a dedicated shutoff switch hidden in plain sight.

2. The system according to claim 1, further comprising at least one of (i) an audio and (ii) a visual indication of activation of the system activation switch.

3. The system according to claim 1, wherein the at least one emergency shutoff switch is situated at various locations within the vehicle.

4. The system according to claim 1, wherein the at least one emergency shutoff switch is one of (i) a wired and (ii) a wireless connection.

5. The system according to claim 1, wherein the engine shutoff element is a fuel shutoff valve.

6. The system according to claim 5, wherein the fuel shutoff valve is a solenoid.

7. The system according to claim 1, wherein the engine shutoff element is an emergency stop circuit.

8. The system according to claim 7, wherein the emergency stop circuit is one of (i) a relay and (ii) a four-pole relay.

9. The system according to claim 1, further comprising an emergency transmitter.

10. The system according to claim 9, wherein the at least one emergency shutoff switch is configured to trigger the emergency transmitter.

11. The system according to claim 9, wherein the at least one emergency shutoff switch is configured to simultaneously trigger the engine shutoff element and the emergency transmitter.

12. The system according to claim 9, wherein the at least one emergency shutoff switch is configured to covertly trigger the emergency transmitter.

13. The system according to claim 9, wherein the emergency transmitter is an emergency position indicating radiobeacon (EPIRB).

14. A method of operating an anti-theft, emergency shutdown system for a vehicle, comprising:

activating, via a system activation switch, at least one emergency shutoff switch; and triggering, via the at least one emergency shutoff switch, an engine shutoff element, thereby initiating instantaneous shutdown of the vehicle engine;

wherein the at least one emergency shutoff switch is a dedicated shutoff switch hidden in plain sight.

15. The method according to claim 14, further comprising providing at least one of (i) an audio and (ii) a visual indication of activation of the system activation switch.

16. The method according to claim 14, wherein the triggering of the engine shutoff element via the at least one emergency shutoff switch occurs by one of (i) a wired and (ii) a wireless connection.

17. The method according to claim 14, wherein the engine shutoff element shuts off fuel supply to the engine via a fuel shutoff valve.

18. The method according to claim 14, wherein the engine shutoff element shuts off fuel supply to the engine via an emergency stop circuit.

19. The method according to claim 14, further comprising triggering, via the at least one emergency shutoff switch, an emergency transmitter.

20. The method according to claim 19, wherein the at least one emergency shutoff switch simultaneously triggers the engine shutoff element and the emergency transmitter.

21. The method according to claim 19, wherein the at least one emergency shutoff switch covertly triggers the emergency transmitter.

22. A method of deterring hostile takeover of a vehicle, comprising:

activating, via a system activation switch, at least one emergency shutoff switch; and triggering, via the at least one emergency shutoff switch, an engine shutoff element, thereby initiating instantaneous shutdown of the vehicle engine;

wherein the at least one emergency shutoff switch is a dedicated shutoff switch hidden in plain sight.

23. The method according to claim 22, further comprising triggering, via the at least one emergency shutoff switch, an emergency transmitter.

24. The method according to claim 23, wherein the at least one emergency shutoff switch simultaneously triggers the engine shutoff element and the emergency transmitter.

25. The method according to claim 23, wherein the at least one emergency shutoff switch covertly triggers the emergency transmitter.

26. An anti-theft, emergency system for a vehicle, comprising:

a system activation switch;

at least one emergency switch; and an emergency transmitter;

wherein the system activation switch is configured to activate the at least one emergency switch, and the at least one emergency switch is configured to trigger the emergency transmitter;

wherein the at least one emergency switch is a dedicated switch hidden in plain sight.

* * * * *